United States Patent [19]

Kato

[11] Patent Number: 4,599,541

[45] Date of Patent: Jul. 8, 1986

[54] SCAN CONVERTER STORAGE TUBE WITH A MULTIPLE COLLECTOR STORAGE TARGET, AND METHOD OF OPERATION

[75] Inventor: Takefumi Kato, Hinode, Japan

[73] Assignee: Iwatsu Electric Co., Ltd., Tokyo, Japan

[21] Appl. No.: 553,301

[22] Filed: Nov. 18, 1983

[30] Foreign Application Priority Data

Dec. 3, 1982 [JP] Japan ..... 57-212375
Dec. 3, 1982 [JP] Japan ..... 57-212376
Dec. 3, 1982 [JP] Japan ..... 57-212377

[51] Int. Cl.[4] ..... H01J 31/06; H01J 31/58

[52] U.S. Cl. ..... 315/8.51; 315/13.11; 328/124; 313/391

[58] Field of Search ..... 315/8.5, 13.11; 313/391, 392, 393, 394, 395, 408; 328/124

[56] References Cited

U.S. PATENT DOCUMENTS 2,618,762 11/1952 Snyder, Jr. ..... 313/391 X
3,626,388 12/1971 Uno et al. ..... 313/395
3,873,873 3/1975 Marlowe ..... 313/391
4,039,888 8/1977 Ashikawa et al. ..... 313/331
4,215,288 7/1980 Kato et al. ..... 313/394
4,288,720 9/1981 Kato et al. ..... 315/13 ST
4,532,453 7/1985 Kato ..... 313/391

FOREIGN PATENT DOCUMENTS 1114948 4/1956 Fed. Rep. of Germany ..... 313/391

OTHER PUBLICATIONS

IBM Technical Disclosure Bulletin, "Deformographic Storage Display Tube Target Structure" by Davis, Jr., vol. 17, No. 9, Feb. 1975, pp. 2738–2742.

*Primary Examiner*—Saxfield Chatmon
*Attorney, Agent, or Firm*—Woodcock Washburn Kurtz Mackiewicz & Norris

[57] ABSTRACT

A scan converter storage tube has a storage target comprising at least two collector electrodes on a storage surface of a storage substrate. Each collector electrode has a multiplicity of parallel spaced strips which are electrically interconnected and which are arranged alternately with the strips of the other collector electrode, leaving exposed parts of the storage surface through the spacings therebetween. The establishment of a potential difference between the collector electrodes makes it possible to write information on the storage target at a high rate without necessitating an increase in an erase potential difference between the collector electrodes and the storage surface. The dual collector storage target also allows writing with a zero erase potential difference, dispensing with the erase mode preparatory to writing. There are also disclosed herein storage targets having three and four collector electrodes respectively.

26 Claims, 20 Drawing Figures

SCAN CONVERTER STORAGE TUBE WITH A MULTIPLE COLLECTOR STORAGE TARGET, AND METHOD OF OPERATION

BACKGROUND OF THE INVENTION

This invention relates to storage tubes in general and, in particular, to scan converter storage tubes for use in oscilloscopes with a waveform storage capability, analog to digital converters, etc. The invention is more particularly directed to a scan converter storage tube featuring a novel storage target comprising a plurality of collector electrodes, and to a method of its operation.

The scan converter tube is a type of storage tube wherein an input signal to be stored (written) is applied to the deflectors for writing its waveform on the storage target by bombarding the same with the deflected beam of electrons. The stored waveform can be later extracted (read) in the form of an electric signal.

Kato et al. U.S. Pat. No. 4,215,288, dated July 29, 1980, teaches a storage target of improved construction for use in the scan converter tube. This prior art storage target has a collector electrode of a striped or latticed pattern on a storage surface of a storage substrate in the form of a single crystal of insulating material such as sapphire. The electron beam bomardment of the target results in the production of hole-electron couples, which make possible the writing of information at an improved rate. Kato et al. U.S. Pat. No. 4,288,720, dated Sept. 8, 1981, proposes a method of erasing information from that prior art storage target. This patent also discloses, by way of reference, the long familiar method of writing and reading information on and from the standard storage target. For a better understanding of the features and advantages of the instant invention, the conventional method of scan converter storage tube operation may be briefly summarized as comprising the following four modes:

1. Preliminary Erasing (Preerasing)

This is the first step of erasure wherein the potential difference between the complete storage surface of the storage substrate and the collector electrode thereon is zeroed.

2. Erasing

As the second or final step of erasure a prescribed potential difference, hereinafter referred to as the erase potential difference Ve, is established between the collector electrode and the complete storage surface of the storage substrate. cl 3. Writing The input waveform is written on the storage target by bombarding the same with the modulated electron beam.

4. Reading

The extraction of the stored waveform from the storage target.

The storage tube disclosed in the above referenced two U.S. patents offers a higher writing speed through an increase in the erase potential difference Ve. For, upon increase in this potential difference, the collector electrode becomes capable of more efficiently capturing the secondary electrons excited from the storage surface by the writing electron beam, as well as the electrons liberated from the hole-electron couples produced within the storage substrate. However, the increased erase potential difference Ve gives rise to greater fluctuations in cutoff voltage at the time of subsequent readout. The cutoff voltage is the collector voltage necessary to distinguish between the written and unwritten regions of the storage target. Its fluctuations occur almost unavoidably because of minute dimensional errors of the collector voltage, particularly the widths and spacings of its stripes. It is therefore impractical to indefinitely increase the erase potential difference Ve for a higher writing speed.

The same holds true if the storage substrate is of glass, silicon dioxide, etc., instead of a single crystal of sapphire or like insulator. Thus the advent of a storage tube has long been awaited which realizes a substantial increase in writing speed without an increase in the erase potential difference Ve.

The prior art storage tubes have had a further problem arising from the fact that their storage target has only one collector electrode. For the repetitive introduction and extraction of information the conventional devices have necessitated the repetition of the noted four steps of preerasing, erasing, writing, and reading. Here again a novel storage tube construction has been awaited which affords a simpler method of operation to reduce the period of time required for each cycle of waveform writing and reading.

An additional shortcoming of the known devices has been that they do not allow the substantially concurrent or selective writing, reading, and erasing of a plurality of signals. This weakness is also the direct result of the fact that their storage target has but one collector electrode.

SUMMARY OF THE INVENTION

The present invention aims, therefore, at a remarkable increase in writing speed in scan converter storage tubes of the class defined, without the difficulties encountered with the prior art.

The invention also seeks to curtail the period of time required for each cycle of the writing and reading of information in such scan converter storage tubes.

The invention further seeks to make possible the selective, or essentially concurrent, writing, reading, and erasing of two or more different input signals on and from a single storage target in such scan converter storage tubes.

Stated broadly in one aspect thereof, the invention provides a novel scan converter storage tube featuring a multiple collector storage target which is to be bombarded by a beam of electrons for the writing of desired information thereon. As the name implies, the multiple collector storage target has two or more collector electrodes formed on a storage surface of a storage substrate of insulating material. Each collector electrode has a group of strips arranged substantially alternately, and in parallel spaced relation, with the other group or groups of collector electrode strips at least in the effective region of the storage target which is to be struck by the electron beam. The storage surface of the storage substrate is of course partly exposed through the spacings between the groups of collector electrode strips.

According to another aspect of the invention there is provided a method of operation for the scan converter storage tube of the above summarized construction. The method dictates, for the writing of information on the multiple collector storage target, the creation of a potential difference between its at least two collector electrodes. In the presence of this intercollector potential difference the effective region of the storage target is bombarded with an electron beam modulated in accordance with the input signal to be written.

It is possible in this manner to write the input signal at as high a rate as approximately 5000 divisions per microsecond, one division being 1.2 millimeters long.

According to another advantage of the invention, writing is possible even if the erase potential difference is zero. This makes the conventional erase mode unnecessary, resulting in substantial reduction of the period required for each cycle of operation.

The invention provides not only dual, but also triple and even quadruple, collector storage targets. In one example of triple collector storage target, for instance, the three groups of collector electrode strips leave exposed two groups of storage surface portions in the effective region of the storage target. This storage target allows two different input waveforms to be selectively written on the respective groups of storage surface portions and to be selectively read out and erased therefrom.

The above and other features and advantages of this invention and the manner of attaining them will become more apparent, and the invention itself will best be understood from a study of the following description and appended claims, with reference had to the attached drawings showing some preferred embodiments of the invention.

DETAILED DESCRIPTION OF THE INVENTION

Storage Tube Construction

Figure 1:
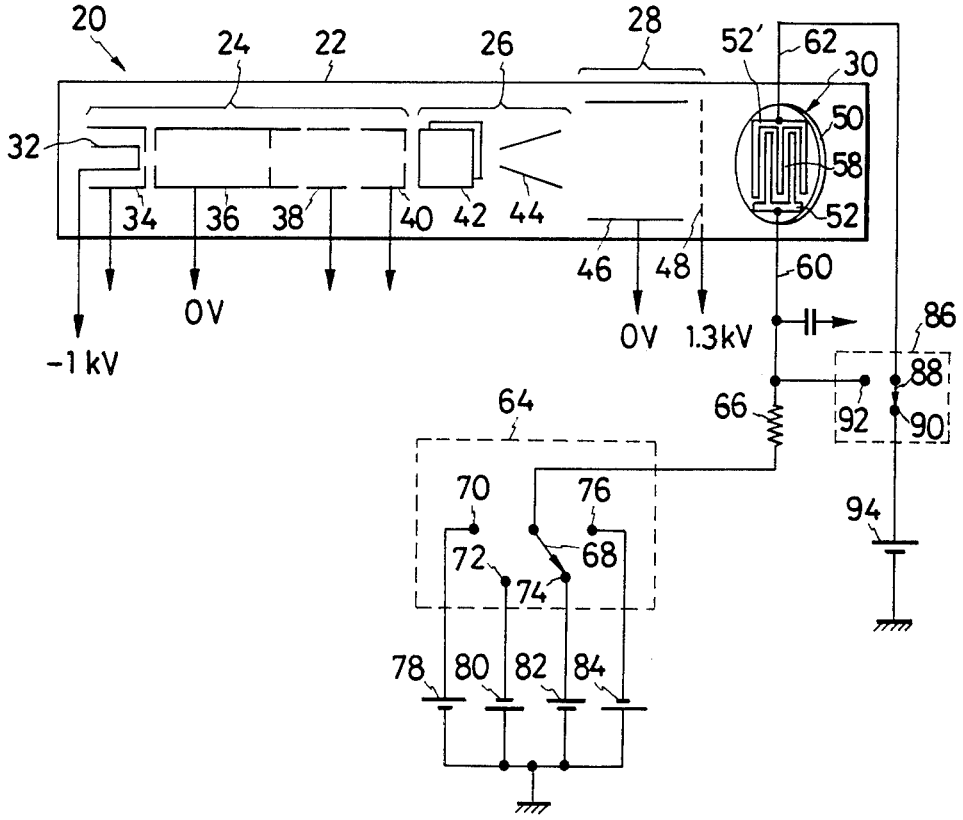
FIG. 1 is a diagrammatic axial section through an example of scan converter storage tube structured to embody the principles of this invention, shown together with a schematic diagram of associated external circuitry for energizing the dual collector storage target of the storage tube.

Reference is first directed to FIG. 1 in order to describe the organization of first preferred form of the scan converter storage tube embodying the principles of this invention. Generally designated 20, the storage tube has a hermetically sealed, tubular vacuum envelope 22. Housed in this vacuum envelope are a modulatable electron beam gun 24, a deflection system 26, a collimation system 28, and a dual collector storage target 30, which are arranged in that order from the left hand toward the right hand end, as viewed in this figure, of the vacuum envelope.

The electron gun 24 conventionally comprises a cathode 32, a control electrode 34, an accelerating electrode 36, a focusing electrode 38, and an astigmatic electrode 40. All these gun components coact in the known manner to generate and emit a coherent beam of electrons directed toward the storage target 30. The deflection system 26 comprises a pair of vertical deflector plates 42 and a pair of horizontal deflector plates 44 for deflecting the electron beam in the two orthogonal directions. The collimation system 28 comprises a wall electrode 46 and a field mesh electrode 48. These electrodes 46 and 48 coact to collimate the low energy beam of electrons, as that in the read mode, for making the paths of the electrons more nearly parallel as they approach the storage target 30.

Figure 2:
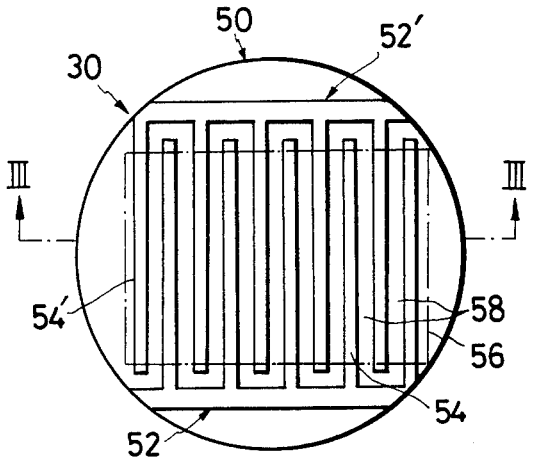
FIG. 2 is an enlarged, diagrammatic plan of the dual collector storage target in the storage tube of FIG. 1.
Figure 3:
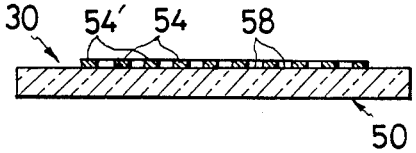
FIG. 3 is a section through the dual collector storage target of FIG. 2, taken along the line III—III therein.

FIGS. 2 and 3 illustrate the dual collector storage target 30 on an enlarged scale. It has a storage substrate 50 in the shape of a disk fabricated from a single crystal of sapphire. On one surface of the storage substrate there are first 52 and second 52' collector electrodes which are electrically disconnected from each other. The monocrystalline sapphire substrate 50 is of course electrically insulating, so that the two collector electrodes 52 and 52' can be electrically disconnected by being physically separated from each other on the substrate.

The two collector electrodes 52 and 52' are both comblike in shape, having groups of parallel spaced strips 54 and 54' extending toward each other in staggered arrangement. The phantom rectangular outline designated 56 in FIG. 2 indicates the effective storage region of the target 30. It will be observed that the collector electrodes 52 and 52' have only their parallel strips 54 and 54' arranged alternately in the effective target region 56. The parallel collector strips 54 and 54' are spaced to expose parts of the storage surface 58 of the substrate 50. These parallel strips may each have a width ranging from 0.5 to 50.0 microns, a thickness ranging from 0.05 micron to the order of several microns, and may be spaced from several microns to several hundred microns. The spacings between the collector stripes 54 and 54' should each be less than the diameter of the electron beam to be emitted by the gun 24, FIG. 1, of the storage tube 20. The effective area 56 of the storage target 30 may be sized, for instance, 10.0 by 12.5 millimeters. Naturally, therefore, the collector strips 54 and 54' are drawn greatly exaggerated in FIGS. 1 and 2. The collector electrodes 52 and 52' may be produced by depositing chromium or like metal on the storage surface 58 of the substrate 50 to the required thickness and then by selectively etching the metal deposit with use of a photoresist.

With reference back to FIG. 1 the first 52 and second 52' collector electrodes of the storage target 30 are coupled to respective leads 60 and 62, extending out of the vacuum envelope 22, for the application of different voltages to the two collector electrodes.

The lead 60 connects the first collector electrode 52 to a multicontact switch 64 via a resistor 66. The switch 64 has a movable contact 68 for selective engagement with four fixed contacts 70, 72, 74 and 76. These fixed contacts are coupled respectively to a first power supply 78 for the preerase mode, a second power supply 80 for the erase mode, a third power supply 82 for the write mode, and a fourth power supply 84 for the read mode. The other lead 62 connects the second collector electrode 52' to a switch 86 having a movable contact 88 and two fixed contacts 90 and 92. The fixed contact 90 is coupled to a second write mode power supply 94, and the fixed contact 92 to the lead 60. The switch 86 connects the second collector electrode 52' to the second write power supply 94 only during operation in the write mode, and to the lead 60 during operation in the preerase, erase, and read modes. Thus, in each of the preerase, erase, and read modes, the same voltage is applied to the two collector electrodes 52 and 52' from the corresponding one of the preerase mode 78, erase mode 80, and read mode 84 power supplies.

FIRST METHOD OF OPERATION

In the operation of the scan converter storage tube 20 of FIG. 1, featuring the dual collector storage tube 30, the cathode 32 may be set at −1000 V; the control electrode 34 at −75 to 0 V with respect to the cathode potential; the acceleration electrode 36 at 0 V (+1000 V with respect to the cathode potential); the focusing electrode 38 and astigmatic electrode 40 at optimum potentials depending upon the electron beam intensity; the wall electrode 46 at 0 V (+1000 V with respect to the cathode potential); and the field mesh electrode 48 at +1300 V (2300 V with respect to the cathode potential).

The scan converter storage tube 20 operates as follows in accordance with the first example of the inventive method. The four operating modes (preerase, erase, write, and read) of the storage tube will be discussed under the respective headings.

Preerase Mode

For the preerase mode, which may be thought of either as a step preparatory to the subsequent erase mode or as the actual first step of erasure, the movable contact 68 of the switch 64 is engaged with the fixed contact 70, and the movable contact 88 of the switch 86 with the fixed contact 92. The result is the connection of both first 52 and second 52' collector electrodes of the storage target 30 to the preerase mode power supply 78. The potential of the two collector electrodes may thus be set at, say, 1350 V (2350 V with respect to the cathode potential). This collector potential must be such that the resulting potential Vs of the storage surface 58 with respect to the cathode potential becomes higher than the first crossover potential V1 (e.g. approximately 15 V) at which the secondary emission ratio (i.e. the average number of secondary electrons per incident primary electron) first becomes unity. Reference is directed to the aforesaid Kato et al. U.S. Pat. No. 4,288,720 for a more extensive discussion of the first crossover potential.

Then the complete effective region 56 of the storage target 30 is bombarded with an unmodulated electron beam from the gun 24. Consequently the entire storage surface 58 of the substrate 50 acquires the same potential of 1350 V (2350 V with respect to the cathode potential) as the collector electrodes 52 and 52'.

As the unmodulated electron beam strikes the target 30 as above, the storage substrate generates both secondary electrons and hole-electron couples. Being set at the highest potential in the storage tube 20, the collector electrodes 52 and 52' effectively capture the liberated secondary electrons and so prevent a rise in the potential of the storage surface 58. Further the hole-electron couples also act to render the storage surface potential equal to the collector potential. It will therefore be understood that practically no erase potential difference Ve, set forth in conjunction with the prior art, develops between storage surface 58 and collector electrodes 52 and 52'.

Erase Mode

The movable contact 68 of the switch 64 is turned into engagement with the fixed contact 72 whereas the movable contact 88 of the other switch 86 is held engaged with the fixed contact 92. Thereupon the erase mode power supply 80 applies a voltage of, say, −990 V (+10 V with respect to the cathode potential) to both first 52 and second 52' collector electrodes of the storage target 30. This collector voltage is determined so that the potential Vs of the storage surface 58 may become less than the first crossover potential V1 (15 V).

Then the complete surface of the storage target 30 is scanned with an unmodulated electron beam from the gun 24. The storage surface 58 of the target gains a potential of −1000 V, which is the same as the cathode potential. The required erase potential difference Ve of 10 V thus develops between the storage surface 58 and the two collector electrodes 52 and 52' thereon.

Write Mode

For writing an input waveform on the storage target 30 the control electrode 34 of the electron gun 24 may be controlled to determine the intensity of the electron beam to be emitted. The input waveform to be written is applied to the pair of vertical deflector plates 42 whereas a sawtooth sweep signal is delivered to the pair of horizontal deflector plates 44.

Further, in accordance with a feature of the invention, different voltages are impressed to the two collector electrodes 52 and 52' of the storage target 30 for the creation of a potential difference therebetween which may range from several volts to several hundred volts. To this end the movable contact 68 of the switch 64 is engaged with the fixed contact 74 to connect the first write mode power supply 82 with the first collector electrode 52. The movable contact 88 of the other switch 86 is engaged with the fixed contact 90 to connect the second write mode power supply 94 with the second collector electrode 52'. The first write mode power supply 82 applies to the first collector electrode 52 a voltage of, say, 9000 V (10,000 V with respect to the cathode potential), which is sufficient to render the potential of the storage surface 58 higher than the noted first crossover potential. The second write mode power supply 94 applies to the second collector electrode 52' a voltage of, say, 9100 V (10,100 V with respect to the cathode potential). The consequent potential difference Vw of 100 V between the two collector electrodes 52 and 52' provides a potential difference of approximately 60 V between the center of the storage surface 58 and the collector electrodes 52 and 52', the 60 V potential difference being the sum of the predetermined erase potential Ve of 10 V and approximately half the potential difference Vw (100/2 V=50 V).

With the potential difference increased as above between the storage surface 58 and the collector electrodes 52 and 52' thereon, the input waveform is written on the target by the deflected electron beam. The electron bombardment of the storage surface 58 creates not only secondary electrons but also hole-electron couples therein. The secondary electrons are efficiently collected and captured by the collector electrode 52'. The hole-electron couples, on the other hand, are quickly separated into holes and electrons, the latter drifting at high velocity toward the collector electrode 52'. The result is a decrease in the rate of recombination of the holes and electrons, affording a substantial increase in writing speed.

The rate of recombination of the holes and electrons in the monocrystalline storage substrate 50 is largely in inverse proportion with the strength of the drift field, that is, the magnitude of the erase potential difference Ve or the intercollector potential difference Vw. Thus the potential difference Vw between the two collector electrodes (100 V in the present case) serves to increase the writing speed of the scan converter storage tube, as more fully explained in the following paragraph.

Upon electron bombardment of the storage target 30 in the presence of the erase potential difference Ve and intercollector potential difference Vw, the hole-electron couples generated within the substrate quickly separate into holes and electrons. The electrons drift to the collector electrode 52, to be arrested thereby, at high velocity owing to the intense electric field due to the erase potential difference Ve and intercollector potential difference Vw. Having a lower drift velocity, the holes are caught in the surface portion of the storage substrate, thereby neutralizing the negative charges and increasing the potential of the storage surface 58 at the region struck with the primary electrons. The writing speed is thus increased.

In cases where the storage substrate is of a noncrystalline insulator such as glass, or of a polycrystalline insulator such as silicon dioxide, information is written by virtue of the emission of secondary electrons, rather than by the action of hole-electron couples within the substrate. Experiment has proved that in such cases, too, the provision of the intercollector potential difference Vw serves to improve the efficiency with which the secondary electrons are captured and so to enable writing at a higher rate.

It will of course be understood that those portions of the storage surface 58 which have not been bombarded by the electrons remain at the same potential as before. The input waveform is therefore retained on the target 30 in the form of a charge (potential) pattern which will not dissipate before the reading operation is initiated and completed.

Read Mode

For reading the charge pattern established by writing, the movable contact 68 of the switch 64 is engaged with the fixed contact 76, and the movable contact 88 of the switch 86 with the fixed contact 92. The read mode power supply 84 applies a voltage of, say, −995 V (+5 V with respect to the cathode potential) to both first 52 and second 52' collector electrodes. The unwritten areas of the storage surface 58 gains a potential of −1005 V (−5 V with respect to the cathode potential), which is lower than the potential (−995 V) of the collector electrodes 52 and 52' by the erase potential difference Ve (10 V). The written areas of the storage surface 58 has of course a higher potential than that of the unwritten areas. The potential of the written areas may, for instance, be −1004 V (−4 V with respect to the cathode potential and −9 V with respect to the collector potential).

Let it be assumed that the potential of the storage surface 58 for cutting off the impingement of the primary electrons on the collector electrodes 52 and 52' is −5 V with respect to the cathode potential. Then the electrons do fall upon those portions of the collector electrodes 52 and 52' which adjoin the −4 V written areas of the storage surface 58, but not on the other collector electrode portions adjoining the −5 V unwritten areas of the storage surface.

Thus, for reading the charge pattern, the complete target surface may be scanned with the unmodulated read beam as in an ordinary television set. There will be obtained the collector current that has been modulated in accordance with the stored charge pattern.

The two collector electrodes 52 and 52' of the storage target 30 may not necessarily be impressed with the same voltage as in the above described read mode. Reading is possible if different voltages are applied to the collector electrodes.

The first operating method of the scan converter storage tube 20, set forth in detail hereinbefore, offers a significant increase in writing speed by virtue of the potential difference Vw created between the two collector electrodes 52 and 52' during writing. A writing speed of as high as 5000 divisions per microsecond is readily attainable, one division being 1.2 millimeters. It should also be appreciated that the erase potential difference Ve can be held at a minimum despite such a high writing speed. The low erase potential difference is effective to correspondingly reduce fluctuations in the cutoff voltage Vc of the storage target 30 due to the manufacturing errors in the dimensions and arrangements of the striped collector electrodes 52 and 52'. Of course, the smaller the fluctuations in cutoff voltage, the higher the signal to noise ratio with which the stored information is read out.

SECOND METHOD OF OPERATION

Figure 4:
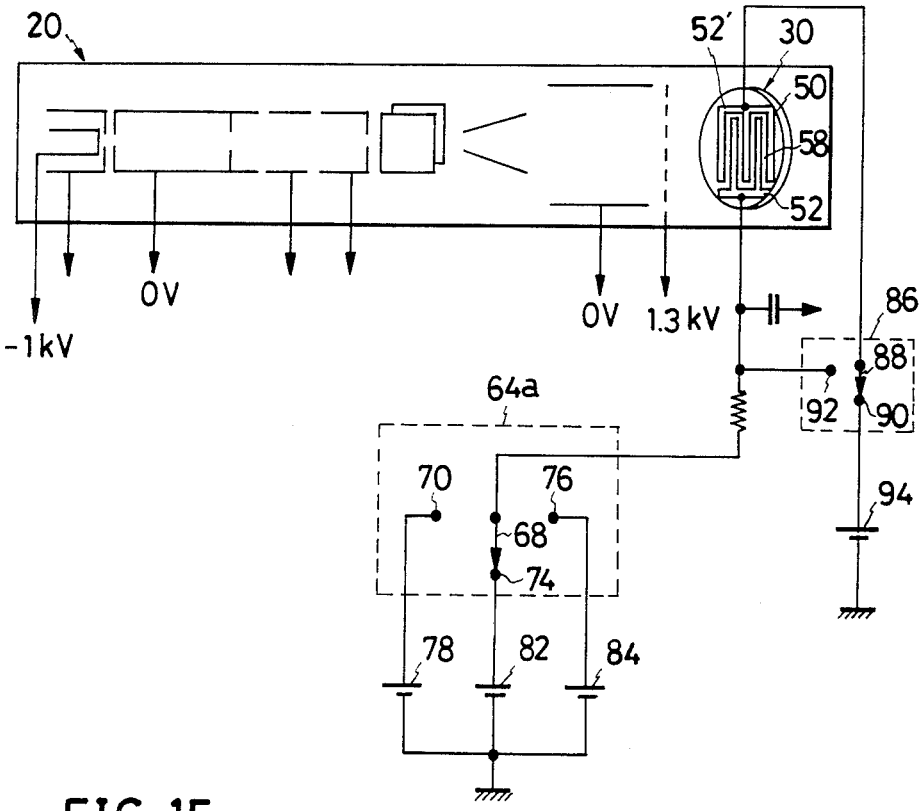
FIG. 4 is a diagram similar to FIG. 1 except that the target energizing circuitry is slightly modified to provide a different method of operation for the scan converter storage tube.

The scan converter storage tube 20 with the dual collector storage target 30 lends itself to another method of operation which dispenses with the erase mode. FIG. 4 shows the scan converter storage tube 20 in combination with modified power supply circuitry for the collector electrodes 52 and 52' of the storage target 30. The storage tube of FIG. 4 is itself identical in construction with that shown in FIG. 1. The power supply circuitry differs from that of FIG. 1 in having no erase mode power supply. Thus it includes a correspondingly modified switch **64*a* having three fixed contacts 70, 74 and 76 connected to the preerase mode power supply 78, write mode power supply 82, and read mode power supply 84, respectively. The other parts of the power supply circuits, as well as the pertinent parts of the storage tube 20, will be identified by the same reference numerals as used to denote the corresponding parts in FIG. 1**.

The scan converter storage tube with the dual collector storage target 30 allows writing even if the erase potential difference Ve is zero. If reading can be destructive, moreover, the preerasing and erasing operations become essentially unnecessary.

For positively priming the target, however, the provision of a step corresponding to the conventional preerasing is desirable. Thus, according to this second method of operation, the storage target 30 is first primed by connecting the movable contact 68 of the switch **64*a* to the fixed contact 70, and the movable contact 88 of the switch 86 to the fixed contact 92. The preerase (more aptly, prime) mode power supply 78 is now connected to both collector electrodes 52 and 52' of the storage target 30. The target is primed by the same way as in the preerasing operation of the first operating method, with the result that the potential of the collector electrodes 52 and 52' becomes equal to that of the storage surface 58**.

This second method of operation features a zero erase potential difference Ve. The erase mode is unnecessary. Writing immediately follows priming.

For the write mode the movable contact 68 of the switch **64*a* is engaged with the fixed contact 74, and the movable contact 88 of the switch 86 with the fixed contact 90. Thus the first collector electrode 52 of the storage target 30 is connected to the first write mode power supply 82 whereas the second collector electrode 52' is connected to the second write mode power supply 94. The input waveform is subsequently written and stored on the storage target 30 by the same manner as in the first described method of operation. The following description of FIGS. 5A through 5E** will make it clear that writing is possible if the erase potential difference Ve is zero.

Figure 5A:
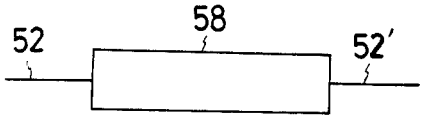
FIGS. 5A through 5E are a series of representations of energy bands explanatory of the way the signal is written on the dual collector storage target of the storage tube of FIG. 4.
Figure 5B:
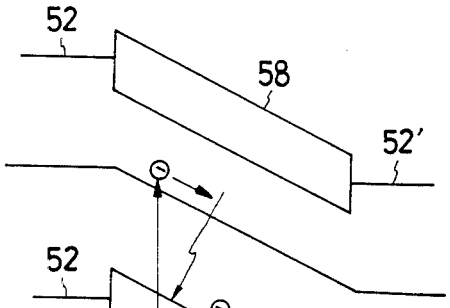
Figure 5C:
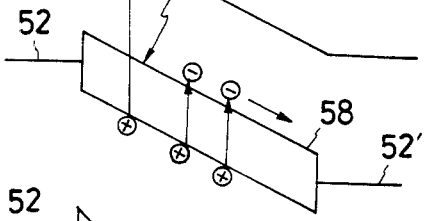
Figure 5D:
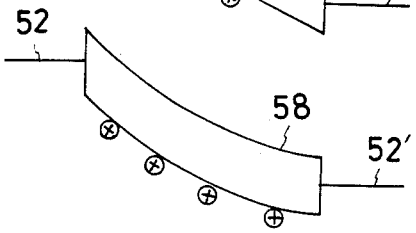
Figure 5E:
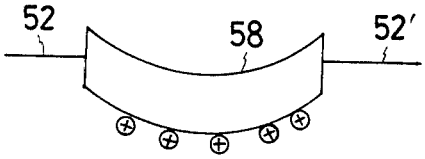

FIG. 5A depicts the state where the storage surface 58 and the two collector electrodes 52 and 52' have gained the same potential by the erasure of the information. In FIG. 5B, different voltages are applied to the collector electrodes 52 and 52' for writing, with the consequent production, at the storage region between the collector electrodes, of the drift field corresponding to the intercollector potential difference Vw (100 V). The collector electrode 52' is assumed to have a higher potential than the other collector electrode 52. With the potential of the storage surface 58 with respect to the cathode potential further made higher than the first crossover potential, the writing beam is applied to the target, resulting in the emission of secondary electrons from the storage surface and the production of hole-electron couples within the substrate, as in FIG. 5C. The emitted secondary electrons and the electrons within the substrate are collected by the collecltor electrode 52' whereas the holes are caught by the substrate, in the neighborhood of its storage surface, to increase its potential. FIG. 5D represents the results.

As is evident from a comparison of FIGS. 5B and 5D, a definite difference exists between the written and unwritten areas of the target.

For reading the information that has been written as above, the two collector electrodes 52 and 52' may both be connected to the read mode power supply 84, FIG. 4, by actuating the switches **64*a* and 86. The application of the same voltage to both collector electrodes causes the curving of the band, as in FIG. 5E, at the written areas of the target, with the result that the midportions of the storage surface 58** acquire a higher potential than that of the collector electrodes. The unwritten areas of the target return to the state of FIG. 5A. There is thus obtained on the target the charge pattern representative of the written information.

The voltage applied to the collector electrodes 52 and 52' in the read mode should be such that the potential of the storage surface 58 becomes higher than the first crossover potential. For the better results the difference between this collector voltage in the read mode and that in the write mode should be of the order of several hundred volts. Further the collector voltage should be the highest of all voltages applied to the various parts of the storage tube.

Then the storage target 30 is scanned with the unmodulated electron beam, just like television scanning, with the same voltage, which has been determined as above, applied to both collector electrodes 52 and 52'. At the written regions of the target, which are in the state of FIG. 5E, part of the electrons created by the primary electron bombardment act to neutralize the holes, so that a relatively limited proportion of the electrons drift to the collector electrodes. No such hole neutralization takes place at the unwritten areas of the target which are in the state of FIG. 5A. Accordingly a greater propotion of the electrons flow into the collector electrodes at the unwritten areas. It is therefore possible to distinguish between the written and unwritten regions depending upon the magnitude of the current from the collector electrodes 52 and 52'. Ideally, upon completion of the reading operation with the storage surface potential made higher than the first crossover potential, the storage surface potential becomes equal to the collector electrode potential, resulting in the priming of the target.

The above second method of operation offers the following advantages:

1. No great voltage change, as well as no extended length of time, is required for a transition from one mode of operation to another because the voltages applied to the collector electrodes 52 and 52' are sufficient to hold the potential of the storage surface 58 above the first crossover potential throughout the complete cycle of priming (preerasing), writing, and reading.

2. As a direct result of the first advantage, reading can immediately follow writing; indeed, writing and reading may be considered nearly concurrent. As adapted for oscilloscopes, the storage tube allows the observation of stored waveforms almost in real time. It is also adptable for analog to digital conversion in pseudoreal time.

3. Writing is possible by virtue of the intercollector potential difference Vw even if the erase potential difference Ve is zero. As the provision of the erase potential difference Ve is thus unnecessary, writing can be started quickly.

4. The target is automatically nearly primed (preerased) upon completion of reading, so that subsequent priming may be omitted.

5. The voltages applied to the collector electrodes in the various modes of operation are not so widely different as in the prior art, making possible the use of less expensive means for changing the voltages.

6. Since the potential of the collector electrodes 52 and 52' in the read mode is the highest in the storage tube, the secondary electrons emitted by the target bombardment of the read beam are not to be caught by the field mesh or other undesired parts, resulting in accurate readout.

SECOND FORM OF STORAGE TUBE

Figure 6:
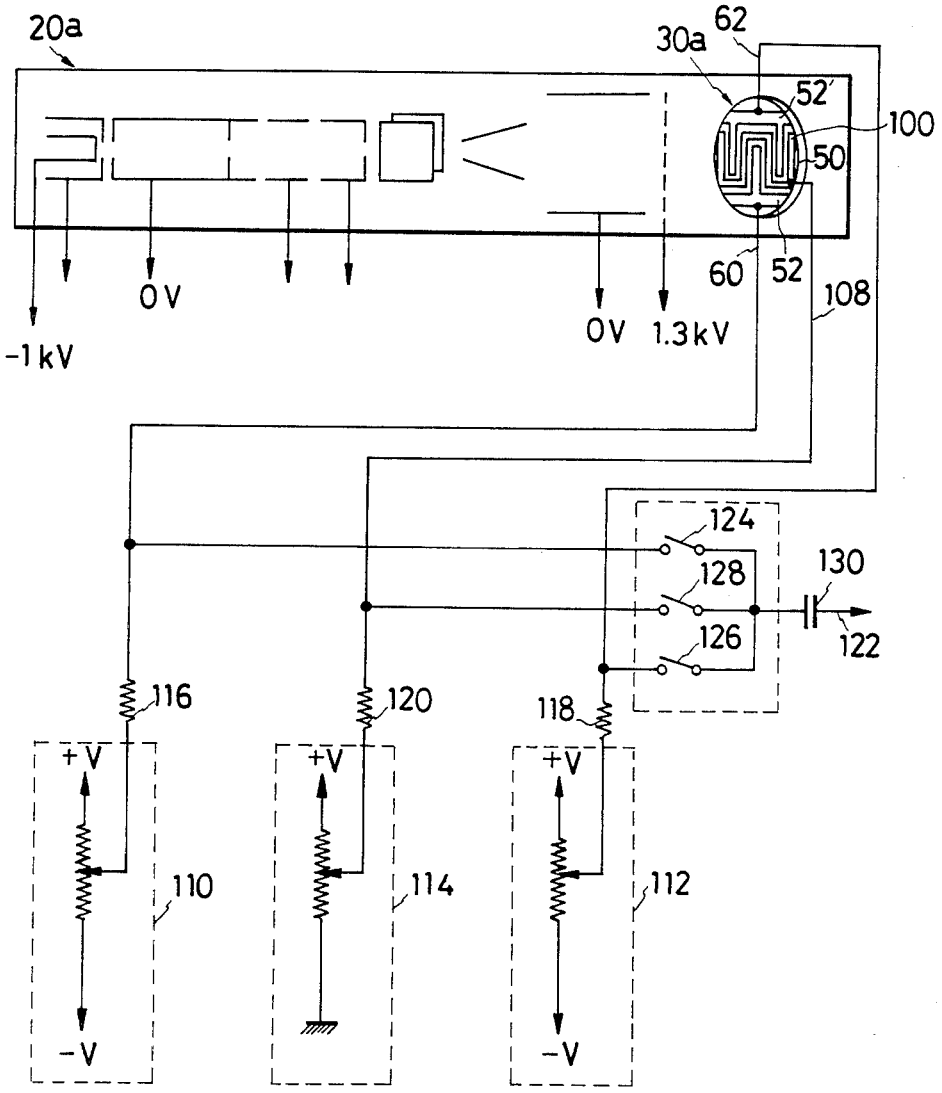
FIG. 6 is a diagram similar to FIG. 1 but showing a further preferable form of the scan converter storage tube and associated target energizing circuitry in accordance with the invention.

FIG. 6 shows another preferable form of the scan converter storage tube in accordance with the invention. The alternative storage tube 20*a* is analogous in construction with the storabe tube 20 of FIG. 1 and that of FIG. 4 except for a storage target 30*a* of triple collector configuration. The circuitry for the application of voltages to the storage target 30*a* is also modified correspondingly.

Figure 7:
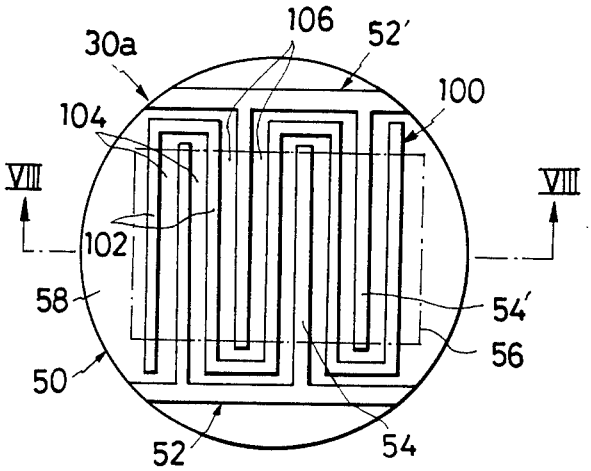
FIG. 7 is an enlarged, diagrammatic plan of the triple collector storage target used in the storage tube of FIG. 6.
Figure 8:
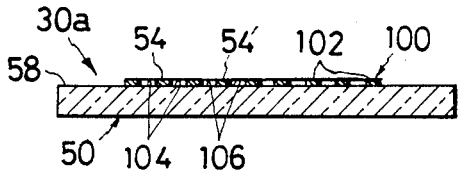
FIG. 8 is a section through the triple collector storage target of FIG. 7, taken along the line VIII—VIII therein.

FIGS. 7 and 8 are enlarged representations of the triple collector storage target 30*a*. This target differs from the target 30 in having a third collector electrode 100 disposed meanderingly between the first 52 and second 52' collector electrodes on the storage surface 58 of the substrate 50. The third collector electrode 100 has parallel strips 102, electrically interconnected, extending rectilinearly between the staggered strips 54 and 54' of the collector electrodes 52 and 52'. Thus, in the effective region 56 of the target 30*a*, the strips 54, 54' and 102 of the three collector electrodes extend in parallel spaced relation to each other, alternating in the order of a first collector strip 54, third collector strip 102, second collector strip 54', third collector strip 102, and back to first collector strip 54. All these collector strips have each a width in the range from 0.5 to 50.0 microns.

It will further be noted from FIGS. 7 and 8 that the three groups of collector strips 54, 54' and 102 are spaced from one another to exposed parts of the storage surface 58 of the substrate 50 in striped pattern. The exposed storage surface portions between each first collector strip 54 and the two third collector strips 102 on its opposite sides are designated 104, and the exposed storage surface portions between each second collector strip 54' and the two third collector strips 102 on its opposite sides are designated 106. All these exposed storage surface portions 104 and 106 have a width less than the diamter of the electron beam to fall thereon, the width being normally from several microns to several hundred microns.

As will be seen by referring again to FIG. 6, the triple collector storage target 30*a* has three leads 60, 62 and 108 extending from the first 52, second 52' and third 100 collector electrodes respectively. These leads connect the three collector electrodes 52, 52' and 100 to first 110, second 112 and third 114 power supply circuits via resistors 116, 118 and 120, respectively. Each power supply circuit is capable of delivering different voltages required in different modes of storage tube operation. It is to be understood that the power supply circuits 110, 112 and 114 are shown as potentiometers purely for the ease of illustration; in practice, separate switches may be provided for the provision of the different voltages required by each collector electrode. The noted three leads 60, 62 and 108 are coupled to a readout line 122 via respective switches 124, 126 and 128 and a common capacitor 130.

OPERATING METHOD OF SECOND STORAGE TUBE

The scan converter storage tube 20*a* of FIG. 6 with the triple collector storage target 30*a* of FIGS. 7 and 8 admits of the writing, reading, and erasing of two different input waveforms onto and from the two groups of storage surface portions 104 and 106 of the target. A description of a typical method follows.

Preerase Mode

For preerasing or priming the storage target 30*a* a voltage of, say, 1350 V (2350 V with respect to the cathode potential) is applied to its three collector electrodes 52, 52' and 100 from the respective power supply circuits 110, 112 and 114. The voltage thus applied to the collector electrodes should be enough to make the potential of the storage surface 58 higher than the first crossover potential. Then the complete effective region 56 of the target 30*a* is scanned with the unmodulated electron beam, with the result that the two groups of storage surface portions 104 and 106 of the target both acquire the same potential (1350 V in this case, or 2350 V with respect to the cathode potential) as the collector electrodes 52, 52' and 100.

Erase Mode

The erase potential difference Ve must then be established between storage surface 58 and collector electrodes 52, 52' and 100. To this end a voltage of, say, −990 V (+10 V with respect to the cathode potential) is applied to the collector electrodes from the respective power supply circuits 110, 112 and 114, and the target is canned with the unmodulated electron beam. The application of the same voltage to the three collector electrodes makes it possible to provide the erase potential difference Ve of 10 V as in the erase mode of the first described method of operation.

The 10 V erase potential difference must then be increased to 15 V according to the present method. Thus, with a voltage of −985 V (+15 V with respect to the cathode potential) applied to the three collector electrodes 52, 52' and 100, the target 30*a* is rescanned with the unmodulated electron beam. This rescanning makes the potential of the storage surface 58 equal to that of the cathode, thereby providing the desired 15 V erase potential difference Ve between storage surface 58 (comprising the two groups of its portions 104 and 106) and collector electrodes 52, 52' and 100.

Write Mode

Figure 9:
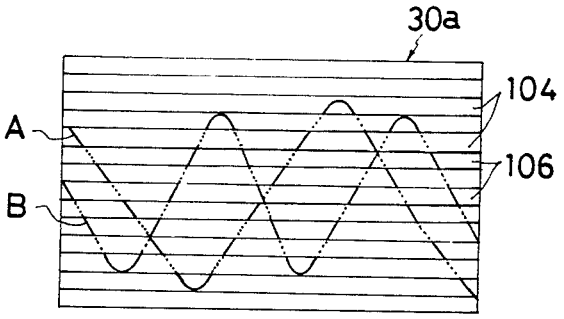
FIG. 9 schematically depicts two different waveforms written on the triple collector storage target of FIGS. 7 and 8.

As depicted by way of example in FIG. 9, two different waveforms A and B can be written on the storage target 30*a* having the 15 V erase potential difference Ve. These waveforms are stored on the different groups of storage surface portions 104 and 106 in the following manner.

For the storage of the first input waveform A a voltage of 9.1 kV (10.1 kV with respect to the cathode potential) is applied to the first collector electrode 52, and a voltage of 9.0 kV (10.0 kV with respect to the cathode potential) is applied to the second 52' and third 100 collector electrodes. Then the target is struck with the electron beam deflected in accordance with the first input waveform A. This waveform is written on the storage surface 58 since its potential has been held above the first crossover potential.

The above application of 9.1 kV to the first collector electrode 52 and 9.0 kV to the second and third collector electrodes 52' and 100 creates a 100 V potential difference Vw between the first and third collector electrodes and no potential difference between the second and third collector electrodes. Thus, between first collector electrode 52 and first group of storage surface portions 104, there is obtained a potentiall difference which is equal to the sum (65 V) of the 15 V erase potential difference Ve and approximately half the 100 V potential difference Vw between the first 52 and third 100 collector electrodes. This is tantamount to an increase in the erase potential difference. For this reason the first collector electrode 52 at high potential efficiently collect the secondary electrons emitted as a result of the primary electron bombardment. Further the hole-electron couples generated within the substrate are disintegrated into holes and electrons, with the latter drifting toward the first collector electrode 52 at high velocity. The holes are caught in the neighborhood of the storage surface, thus neutralizing the negative charges and so contributing to the potential increase of the first storage surface portion 104. Consequently the first input waveform A is stored at a high level on the first group of storage surface portions 104 between the first 52 and third 100 collector electrodes.

Of course, the writing beam strikes the second group of storage surface portions 106 between the second 52' and third 100 collector electrodes. Since there is no potential difference therebetween, however, the first input waveform A is written at a significantly lower level on this second group of storage surface portions.

For the subsequent writing of the second input waveform B, a voltage of 9.1 kV (10.1 kV with respect to the cathode potential) is impressed to the second collector electrode 52', and that of 9.0 kV (10.0 kV with respect to the cathode potential) to the first 52 and third 100 collector electrodes. Then the target 30*a* is scanned with the writing electron beam that has been deflected with the second input waveform. The storage surface 58 has been held at a potential above the first crossover potential, so that the second input waveform is written thereon.

However, during the writing of the second input waveform B, a potential difference Vw of 100 V exists between second 52' and third 100 collector electrodes, and no potential difference between first 52 and third 100 collector electrodes. Accordingly, as has been set forth in conjunction with the writing of the first input waveform A, there is obtained between second collector electrode 52' and and second group of storage surface portions 106 a potential difference of approximately 65 V, which is the sum of the 15 V erase potential difference Ve and approximately half the 100 V intercollector potential difference Vw. The second collector electrode 52' efficiently collects the secondary electrons as well as the electrons from the hole-electron couples generated within the storage substrate. Thus the second input waveform is written at a high level on the second group of storage surface portions 106 and at a lower level on the first group of storage surface portions 104.

With the low level storage of the input information disregarded, it can be stated that only the first waveform A has been written as above on the first group of storage surface portions 104, and only the second waveform B on the second group of storage surface portions 106. FIG. 9 schematically indicates, by the alternating solid and dashed lines, the two waveforms A and B thus written on the two groups of storage surface portions 104 and 106 of the target 30*a*.

Alternative Write Mode

The second 52' and third 100 collector electrodes may not necessarily be held at the same potential for the writing of the first input waveform A, as in the above described write mode. The second and third collecltor electrodes may be held at arbitrary potentials lower than the potential difference Vw (100 V) between the first 52 and third 100 collector electrodes. All that is required for writing at different levels is that the potential difference between the first 52 and third 100 collector electrodes differ from the potential difference between the second 52' and third 100 collector electrodes.

Read Mode

The two waveforms A and B written on the storage target 30*a* as above can be read out selectively. For reading the first waveform A, a voltage of −990.5 V (+9.5 V with respect to the cathode potential) is applied to each of the first 52 and third 100 collector electrodes, and a voltage of −1005.0 V (−5.0 V with respect to the cathode potential) to the second collector electrode 52'.

Since the erase potential difference Ve is 15 V, the potential of the unwritten areas of the first storage surface portions 108 becomes −1005.5 V, which is lower than the −990.5 V potential of the first 52 and third 100 collector electrodes by the 15 V erase potential difference. Further the potential of those parts of the first storage surface portions 104 where the first waveform A has been stored at the high level becomes, for instance, −1004.5 V (−4.5 V with respect to the cathode potential). The potential of those parts of the first storage surface portions 108 where the second waveform B has been stored at the low level becomes, for instance, −1005.0 V (−5.0 V with respect to the cathode potential).

The second collector electrode 52' has now the potential of −1005.0 V as above. Accordingly the potentials of both written (at high and low levels) and unwritten areas of the second group of storage surface portions 106 become less than −1005.0 V (−5.0 V with respect to the cathode potential).

Let it be assumed that the influx of the electron beam into the three collector electrodes 52, 52' and 100 of the storage target 30*a* is inhibited when the potential of its storage surface 58 with respect to the cathode potential is −5.0 V. Then it becomes possible to read out only the first waveform A by scanning the complete effective region 56 of the target with the read beam, with the voltages of −990.5 V and −1005.5 V (+9.5 V and −5.0 V, respectively, with respect to the cathode potential) applied as above to the first 52 and third 100 collector electrodes and to the second collector electrode 52' respectively. For only those parts of the first group of storage surface portions 104 where the first waveform A has been stored have a potential of −4.5 V, higher than the above assumed cutoff voltage of −5.0 V.

Those fragments of the first waveform A which have been stored on the second group of storage surface portions 106 cannot possibly be read out at the same time with the above readout of the first waveform fragments from the first group of storage surface portions 104. This presents no serious problem, however, as the first waveform fragments extracted from the first group of storage surface portions 104 convey sufficient information for all practical purposes.

It is understood that in the above read mode, the switches 124, 126 and 128, FIG. 6, have all been closed, connecting the collector electrodes 52, 52' and 100 to the readout line 122 via the capacitor 130.

The second waveform B can be read out in a like manner. A voltage of −990.5 V (+9.5 V with respect to the cathode potential) is applied to each of the second 52' and third 100 collector electrodes, and that of −1005.0 V (−5.0 V with respect to the cathode potential) to the first collector electrode 52. Consequently the potential of those parts of the second group of storage surface portions 106 where the second waveform B has been stored at the high level becomes, for instance, −4.5 V with respect to the cathode potential. The potential of those parts of the second group of storage surface portions 106 where the first waveform A has been stored at the low level becomes, for instance, −5.0 V with respect to the cathode potential. The potential of the other, unwritten areas of the second group of storage surface portions 106 becomes, for instance, −5.5 V with respect to the cathode potential. As −5.0 V is being impressed to the first collector electrode 52, the potential of the first group of storage surface portions 104, inclusive of both written and unwritten areas thereof, becomes less than the cutoff voltage (−5.0 V).

It is seen from the preceding paragraph that only those parts of the second group of storage surface portions 106 where the second waveform B has been written at the high level has a potential above the cutoff voltage. Thus the scanning of the storage target 30*a* with the read beam enables the readout of only the second wavefor B.

As required, the waveforms A and B written only on the first group of storage surface portions 104 may be read out. Toward this end a voltage of −990.0 V (+10.0 V with respect to the cathode potential) may be applied to each of the first 52 and third 100 collector electrodes, and that of −1005.0 V (−5.0 V with respect to the cathode potential) to the second collector electrode 52'. Thereupon the potential of those parts of the first group of storage surface portions 104 where the first waveform A has been written becomes −1004.0 V (−4.0 V with respect to the cathode potential). The potential of those parts of the first group of storage surface portions 104 where the second waveform B has been written becomes −1004.5 V (−4.5 V with respect to the cathode potential). The potential of the other, unwritten areas of the first group of storage surface portions 104 become −1005.0 V (−5.0 V with respect to the cathode potential). The potential of the second group of storage surface portions 106 is held below the cutoff voltage (−5.0 V) under the influence of the voltage applied to the second collector electrode (−5.0 V with respect to the cathode potential).

It will have been noted that only the potentials of those parts of the frist group of storage surface portions 104 where the first and second waveforms have been stored become higher than −5.0 V with respect to the cathode potential. Thus the scanning of the target with the read beam enables the readout of the waveforms A and B from only the first group of storage surface portions 104.

A readout of the waveforms A and B from only the second group of storage surface portions 106 is possible through a like procedure. A voltage of −990.0 V (+10.0 V with respect to the cathode potential) may be applied to each of the second 52' and third 100 collector electrodes, and that of −1005.0 V (−5.0 V with respect to the cathode potential) to the first collector electrode 52. The waveforms A and B will be extracted from the second group of storage surface portions 106 upon subsequent scanning of the target with the read beam.

Alternative Preerase and Erase Modes

Discussed hereinbelow is a method of preerasing or priming only the first group of storage surface portions 104 of the triple collector storage target **30*a***, with the subsequent establishment of the erase potential difference Ve.

A voltage of, say, −850.0 V (−150.0 V with respect to the cathode potential) is impressed to the first collector electrode 52 for making the potential of the first group of storage surface portions 104 higher than the first crossover potential. A voltage of, say, −1030.0 V (−30.0 V with respect to the cathode potential) is impressed to the second collector electrode 52' for preventing the impingement of the electron beam on the second group of storage surface portions 106. Further a voltage close to the first crossover potential, say, −985.0 V (+15.0 V with respect to the cathode potential), is applied to the third collector electrode 100.

Then the entire effective region 56 of the storage target **30*a* is scanned with the unmodulated electron beam. Thus electron bombarded with its potential held above the first crossover potential, the first group of storage surface portions 104 gains a potential approximately equal to that of the first collector electrode 52 and so becomes primed. The second group of storage surface portions 106, on the other hand, is shielded from the electrons by the second collector electrode 52', thereby retaining the information that has been written thereon. The selective priming of only the first group of storage surface portions 104** is thus accomplished.

For the establishment of the erase potential difference Ve between first group of storage surface portions 104 and first collector electrode 52, a voltage of, say, −990.0 V (+10.0 V with respect to the cathode potential) may be applied to the first collector electrode for making the potential of the first group of storage surface portions less than the first crossover potential. Then, with the potentials of the other collector electrodes 52' and 100 held the same as in the preerase mode, the target is scanned with the unmodulated electron beam. Since then the potential of the first group of storage surface portions 104 becomes the same as the cathode potential, the 10.0 V erase potential difference is obtained.

A still higher value of the erase potential difference Ve is likewise obtainable. For the provision of a 15 V erase potential difference, for instance, the potential of the first collector electrode 52 may be set at −985 V. Upon subsequent electron bombardment of the target the potential of the first group of storage surface portions 104 will again become the same as the cathode potential, resulting in the provision of the desired 15 V erase potential difference.

Second Alternative Write Mode

The scan converter storage tube **20*a* with the triple collector storage target 30*a* allows still another write mode whereby information can be written on a selected one of the two groups of storage surface portions 104 and 106**. The following description of this selective write mode presupposes the presence of a 15 V erase potential difference.

For writing on only the first group of storage surface portions 104, a voltage of −800 V (+200 V with respect to the cathode potential) is applied to the first collector electrode 52, a voltage of −1015 V (−15 V) to the second collector electrode 52', and a voltage of −985 V (+15 V) to the third collelctor electrode 100. Thereupon the first group of storage surface portions 104 generally gains a potential above the 15 V first crossover potential. The second group of storage surface portions 106, on the other hand, is shielded against electron bombardment by virtue of the negative potential of the second collector electrode 52'.

The target may then be bombarded with the write beam. The beam will fall on only the first group of storage surface portions 104, creating thereon the charge pattern representative of the input waveform. The second group of storage surface portions 106, being not struck with the write beam, will have no information written thereon.

For writing on only the second group of storage surface portion 106, a voltage of −1015 V (−15 V with respect to the cathode potential) is applied to the first collector electrode 52, a voltage of −800 V (+200 V) to the second collector electrode 52', and a voltage of −985 V (+15 V) to the third collector electrode 100. The target may then be struck with the write beam modulated in accordance with the input waveform.

Establishment of Different Erase Potential Differences

According to another operational feature of the triple collector storage target 30*a*, two different erase potential differences Ve1 and Ve2 can be provided respectively between first collector electrode 52 and first group of storage surface portions 104 and between second collector electrode 52' and second group of storage surface portions 106. The two different erase potential differences may be created either concurrently or successively.

For the concurrent establishment of the erase potential differences Ve1 and Ve2, the first collector electrode 52 may be applied with a voltage (e.g. −992 V, or +8 V with respect to the cathode potential) capable of making the potential of the first group of storage surface portions 104 less than the first crossover potential. The second collector electrode 52' may be applied with a voltage (e.g. −988 V, or +12 V with respect to the cathode potential capable of making the potential of the second group of storage surface portions 106 less than the first crossover potential. The third collector electrode 100 may be applied with a voltage (e.g. −990 V, or +10 V with respect to the cathode potential) capable of making the potentials of the first and second groups of storage surface portions 104 and 106 less than the first crossover potential.

Then the target 30*a* is thoroughly scanned with the unmodulated beam. Now the first 104 and second 106 groups of storage surface portions both gain the cathode potential. There are thus obtained the first erase potential difference Ve1 of approximately 8 V on the average between first collector electrode 52 and first group of storage surface portions 104, and the second erase potential difference Ve2 of approximately 12 V on the average between second collector electrode and second group of storage surface portions 106.

For the successive establishment of the two different erase potential differences a voltage of, say, −992 V (+8 V with respect to the cathode potential) may first be applied to each of the first 52 and third 100 collector electrodes. The second collelctor electrode 52' may be applied with a voltage of, say, −1015 V (−15 V with respect to the cathode potential) which is capable of cutting off the electron beam. Then the target is scanned with the unmodulated beam. An 8 V first erase potential difference is thus created. Then a voltage of, say, −988 V (+12 V with respect to the cathode potential) may be impressed to each of the second 52' and third 100 collector electrodes. The first collecltor electrode 52 may be applied with a voltage of, say, −1015 V (−15 V with respect to the cathode potential) which is capable of cutting off the electron beam. Then the target may be rescanned with the unmodulated beam, resulting in the establishment of a 12 V second erase potential difference.

The provision of the two different erase potential differences Ve1 and Ve2 makes it possible to write input waveforms with the three collector electrodes 52, 52' and 100 held at the same potential. The information will then be stored, for instance, at a low level on the first group of storage surface portions 104 and at a high level on the second group of storage surface portions 106.

THIRD FORM OF STORAGE TUBE

Figure 10:
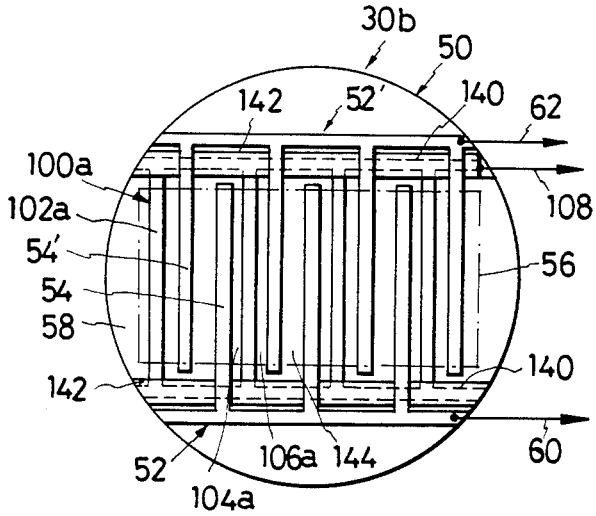
FIG. 10 is a diagrammatic plan of still another example of storage target in accordance with the invention.

The third preferred form of the scan converter storage tube in accordance with the invention comprises a modified triple collector storage target 30*b* shown in FIG. 10. This modified target is intended for use in place of the storage target 30*a* in the storage tube 20*a* of FIG. 6.

The modified triple collector storage target 30*b* features a third collector electrode 100*a* of ladderlike configuration, substituted for the meandering third collector electrode 100 in the target 30*a* of FIGS. 7 and 8. The first 52 and second 52' collector electrodes are shaped and arranged substantially like those of the FIGS. 7 and 8 target, so that any repeated description of these electrodes 52 and 52' is considered unnecessary.

The ladderlike third collector electrode 100*a* is formed on the storage substrate 50 in generally underlying relation to the two other collector electrodes 52 and 52'. It comprises a plurality or multiplicity of strips 102*a* extending in parallel spaced relation to each other and to the strips 54 and 54' of the first 52 and second 52' collector electrodes, and a pair of connector strips 140 extending across the first and second collector strips 54 and 54' and electrically interconnecting the third collector strips 102*a*. A pair of insulating layers 142 are interposed between the connector strips 140 and the first and second collector strips 54 and 54' for electrically insulating them.

Thus, in the effective region 56 of the storage target 30*b*, the strips 54, 54' and 102*a* of the three collector electrodes 52, 52' and 100*a* extend in parallel spaced relation to each other as in the FIGS. 7 and 8 target 30*a*. In this storage target 30*b*, however, the collector strips are arranged in the order of a first collector strip 54, a third collector strip 102*a*, a second collector strip 54', and back to another first collector strip 54. The storage surface 58 of the substrate 50 is exposed at 104*a* between each neighboring pair of first 54 and third 102*a* collector strips, at 106*a* between each neighboring pair of second 54' and third 102*a* collector strips, and at 144 between each neighboring pair of first 54 and second 54' collector strips. It will also be noted that the exposed storage surface portions 144 between the first 54 and second 54 collector strips are wider than the other exposed storage surface portions 104*a* and 106*a*. As in the FIG. 6 storage tube the three collector electrodes 52, 52' and 100*a* are coupled to the respective power supply circuits via the leads 60, 62 and 108.

The operation of the scan converter storage tube with the modified triple collector storage target 30*b* is believed to be apparent from the description of the preceding embodiments. One functional feature characterizing the storage target 30*b*, however, is that the capacitances between the collector strips bounding the storage surface portions 104*a* and 106*a* are higher than those between the collector strips bounding the storage surface portions 144. The storage surface portions 104*a* and 106*a* are therefore suitable for low sweep speed writing, and the storage surface portions 144 for high sweep speed writing.

ADDITIONAL EMBODIMENTS

Figure 11:
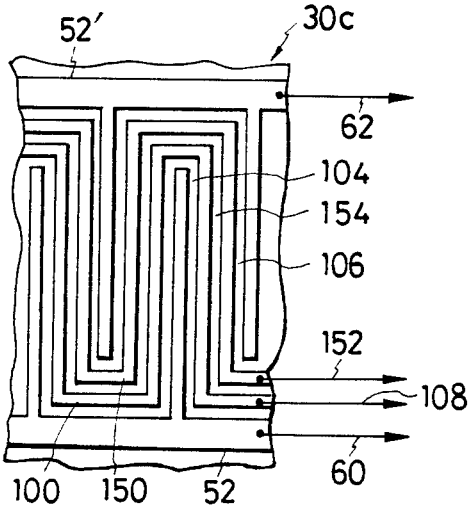
FIG. 11 is a fragmentary, diagrammatic plan of a further example of storage target in accordance with the invention.

Both double and triple collector storage targets have been disclosed in the foregoing. The invention further provides, then, a quadruple collector storage target depicted fragmentarily in FIG. 11. Generally designated 30*c*, the quadruple collector storage target is shown as a slight modification of the FIGS. 7 and 8 storage target 30*a*, additionally comprising a fourth collector electrode 150 of meandering shape interposed, together with the third collector electrode 100, between the first 52 and second 52' collector electrodes. The four collector electrodes 52, 52', 100 and 150 are coupled to respective power supplies via leads 60, 62, 108 and 152.

The four collector electrodes 52, 52', 100 and 150 define the three groups of storage surface portions 104, 106 and 154 in the effective region of the target. These groups of storage surface portions allow the selective writing, reading, and erasing of input waveforms much the same way as set forth in connection with the preceding embodiments.

Figure 12:
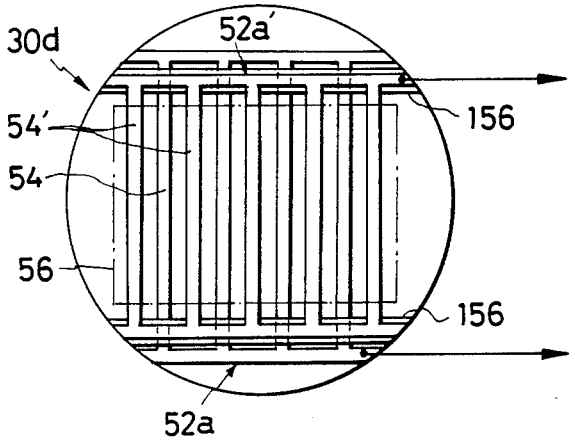
FIG. 12 is a diagrammatic plan of a further example of storage target in accordance with the invention.

In FIG. 12 is shown a slight modification of the dual collector storage target 30 of FIGS. 2 and 3. The modified storage target 30*d* has two collector electrodes 52*a* and 52'*a* which are both of ladderlike shape. The first collector electrode 52*a* underlies the second 52'*a*. Disposed outside the effective target region 56, a pair of insulating bands 156 electrically insulate the two collector electrodes from each other. In the effective region 56 the strips 54 and 54' of the collector electrodes are arranged alternately in parallel spaced relation to one another, so that this storage target 30*d* is essentially equivalent to the FIGS. 2 and 3 storage target 30.

It is apparent that the principles of FIG. 12 are applicable to the triple collector storage targets in accordance with the invention. Thus, in the FIG. 10 triple collector storage target 30*b*, for example, all the collector electrodes could be of ladderlike shape.

Figure 13:
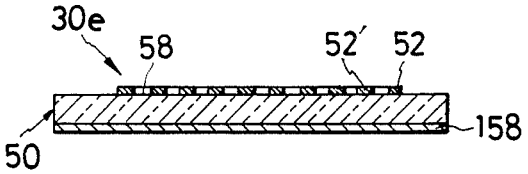
FIG. 13 is a diagrammatic section through a further example of storage target in accordance with the invention.

FIG. 13 also shows a slight modification of the FIGS. 2 and 3 dual collector storage target 30. The modified storage target 30*e* features a backing electrode 158, itself conventional, on the surface of the monocrystalline sapphire substrate 50 opposite to its storage surface 58 bearing the two collector electrodes 52 and 52'. A required voltage is to be applied to the backing electrode 158 in the operation of the storage tube incorporating this target. A similar electrode may of course be provided in cases where the substrate has three or more collector electrodes on its storage surface.

Figure 14:
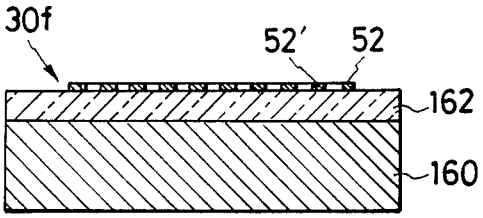
FIG. 14 is a diagrammatic section through a further example of storage target in accordance with the invention.

It is to be understood that the monocrystalline sapphire substrate 50 is not an essential feature of this invention. In an additional example of storage target 30*f* shown in FIG. 14 the monocrystalline sapphire substrate is replaced by a combination of a monocrystalline silicon layer 160 and a polycrystalline silicon dioxide storage layer 162. Colllector electrodes, such as those designated 52 and 52', are formed on the storage layer 162.

Figure 15:
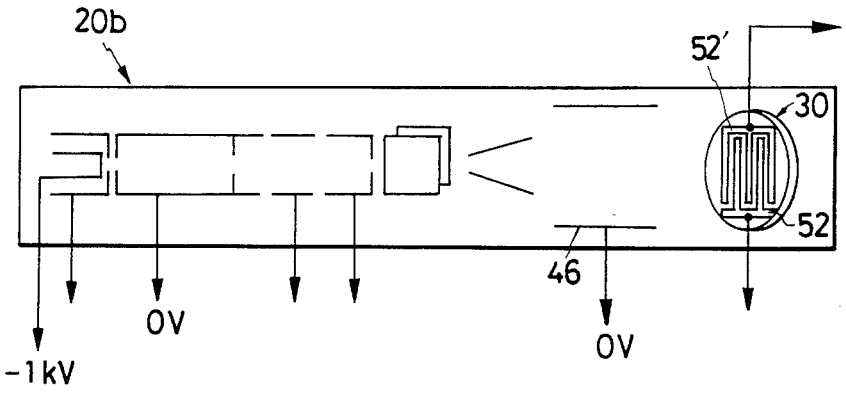
FIG. 15 is a diagrammatic axial section through a further example of scan converter storage tube in accordance with the invention.

FIG. 15 is an illustration of a modified storage tube 20*b*, differing from the storage tubes 20 and 20*a* only in having no field mesh electrode. The storage target 30 is shown incorporated in this modified storage tube 20*b* by way of example. The omission of the field mesh electrode not only presents no impediment to the writing and reading of information in accordance with the teachings of the instant invention but also offers some positive advantages. One of these is that since the beam of primary electrons is not to be caught by the field mesh electrode, the electron beam more efficiently impinges on the target to assure a higher writing speed. Another is an increase in resolution through the elimination of "writing" by secondary electrons from the field mesh electrode.

In the reading and writing operations by the FIG. 15 storage tube 20*b* the wall electrode 46 may affect the storage target 30 the same way as would the field mesh electrode. Desirably, therefore, the potentials of the collector electrodes 52 and 52' of the target 30 may be set higher than that of the wall electrode 46.

Figure 16:
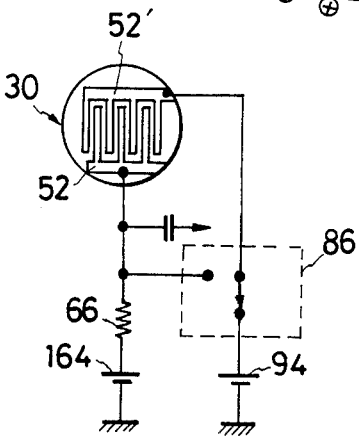
FIG. 16 is a schematic electrical diagram of a modification of energizing circuitry for the storage target of FIGS. 2 and 3.

FIG. 16 represents modified means for the application of voltages to the collector electrodes 52 and 52' of the storage target 30 in the storage tube 20 of FIG. 4, in the practice of the second described method of its operation. The first collector electrode 52 is coupled to a single power supply 164 via the resistor 66 whereas the second collector electrode 52' can be selectively coupled, via the switch 86, to the power supply 94 and to the first recited power supply 164. The power supplies 94 and 164 are voltage sources capable of delivering voltages with a difference of, say, 100 V. In the prime (preerase) and read modes the same voltage may be applied from the power supply 164 to both collector electrodes 52 and 52'. In the write mode, different voltages may be applied to the collector electrodes from the respective power supplies 94 and 164.

POSSIBLE MODIFICATIONS

It is understood that the foregoing detailed disclosure is by way of example only and not to impose limitations upon this invention, as a variety of modifications or variations of the invention will readily occur to the electronics specialists. The following is a brief list of such possible modifications or variations, all considered to fall within the scope of the present invention set forth in the appended claims:

1. The substrate of the storage target may not necessarily be a single crystal of sapphire but that of magnesium oxide, magnesium fluoride, calcium fluoride, etc. It may also be fabricated from a noncrystalline insulator such as glass.

2. The collector electrodes of the storage target may each be one or more layers of conductive material such as chromium, aluminum, nickel, molybdenum and gold, or may be transparent electrodes of stannic oxide or the like.

3. The parallel strips of the collector electrodes may not necessarily be oriented in the direction of horizontal beam scanning but at right angles therewith.

4. The collimation system of the storage tube, comprising the wall electrode and field mesh electrode, may be omitted.

5. The storage tube may be adapted for the storage of digital signals.

6. The storage substrate of the storage target may take the form of an insulating layer overlying a base layer of alumina or the like.

7. In the storage tube 20*a* of FIG. 6 the three collector electrodes of the storage target 30*a* may not be coupled to the common capacitor via the switches 124, 126 and 128 but to respective capacitors for separate signal readout.

8. Contrary to the above detailed disclosure an input signal to be written may be delivered to the X-deflector system, and a sawtooth sweep signal to the Y-deflector system.

9. The storage tube in accordance with the invention lends itself to applications where two input signals are delivered respectively to the X- and Y-deflector systems for writing on the storage target the waveform determined by the two input signals.

10. The multiple collectors of the storage target may be made electrically interconnectable, by means outside the storage tube envelope, in order that the target may be used like the standard single collector target as well.

What is claimed is:

1. A scan converter storage tube comprising:

(a) an evacuated envelope;

(b) an electron gun within the envelope for generating a beam of electrons;

(c) means for deflecting the electron beam; and (d) a storage target having an effective region adapted to be bombarded by the electron beam, the storage target comprising a storage substrate having a storage surface, and a plurality of collector electrodes formed on the storage surface of the storage substrate and electrically insulated from each other by the storage substrate, the collector electrodes having respective groups of strips arranged substantially alternately and extending in parallel spaced relation with each other at least in the effective region of the storage target, the collector electrodes being adapted to be impressed with voltages and being effective to provide between themselves and the storage substrate potential differences dependent upon differences in the voltages being impressed upon each of said collector electrodes.

2. The scan converter storage tube of claim 1 wherein the storage substrate of the storage target is a single crystal of insulating material.

3. The scan converter storage tube of claim 2 wherein the insulating material is sapphire.

4. The scan converter storage tube of claim 1 wherein the storage substrate of the storage target is of polycrystalline insulating material.

5. The scan converter storage tube of claim 1 wherein the storage substrate of the storage target is of noncrystalline insulating material.

6. The scan converter storage tube of claim 1 wherein the collector electrodes of the storage target comprise:

(a) a first collector electrode having the first group of strips which are electrically connected to one another and which are arranged parallel to one another with constant spacings therebetween; and (b) a second collector electrode having the second group of strips which are electrically connected to one another and which are arranged parallel to one another with constant spacings therebetween;

(c) the first and second groups of strips being arranged alternately in the effective region of the storage target with spacings therebetween to expose parts of the storage surface of the storage substrate.

7. The scan converter storage tube of claim 6 wherein the first and second collector electrodes are each comblike in shape.

8. The scan converter storage tube of claim 6 wherein the collector electrodes of the storage target further comprise a third collector electrode arranged meanderingly between the first and second collector electrodes, the third collector electrode thus providing a third group of strips extending in parallel spaced relation with the second and third groups in the effective region of the storage target.

9. The scan converter storage tube of claim 8 wherein the strips of the first, second and third collector electrodes are arranged in the effective region of the storage target in the repetitive order of a first collector electrode strip, a third collector electrode strip, a second collector electrode strip, and a third collector electrode strip.

10. The scan converter storage tube of claim 6 wherein the collector electrodes of the storage target further comprise a third collector electrode having a third group of strips extending in parallel spaced relation with one another and with the first and second groups of strips in the effective region of the storage target, the strips of the first, second and third collector electrodes being arranged in the effective region of the storage target in the repetitive order of a first collector electrode strip, a third collector electrode strip, and a second collector electrode strip.

11. The scan converter storage tube of claim 10 wherein the first and second collector electrodes are both comblike in shape, wherein the third collector electrode is ladderlike in shape, and wherein the storage tube further comprises means for electrically insulating the the third collector electrode from the first and second collector electrodes.

12. The scan converter storage tube of claim 10 wherein the spacings between the first and second collector electrode strips are wider than the spacings between the first and third collector electrode strips and the spacings between the second and third collector electrode strips.

13. The scan converter storage tube of claim 6 wherein the collector electrodes of the storage target further comprise third and fourth collector electrodes arranged meanderingly between the first and second collector electrodes, the third and fourth collector electrodes providing third and fourth groups of strips arranged in parallel spaced relation with one another and with the first and second groups of strips in the effective region of the storage target.

14. The scan converter storage tube of claim 6 wherein the first and second collector electrodes are both ladderlike in shape, with one collector electrode partly overlying the other, and wherein the storage tube further comprises means for electrically insulating the first and second collector electrodes from each other.

15. The scan converter storage tube of claim 1 wherein the storage target further comprises a backing electrode on the surface of the storage substrate opposite to the storage surface thereof.

16. The scan converter storage tube of claim 1 wherein the storage substrate of the storage target is a laminate of a monocrystalline silicon layer and a polycrystalline silicon dioxide layer, the latter having the storage surface bearing the collector electrodes thereon.

17. The scan converter storage tube of claim 1 further comprising a field mesh electrode interposed between the deflecting means and the storage target.

18. A method of operation for a scan converter storage tube which comprises:

(a) providing a scan converter storage tube with a storage target having at least two collector electrodes formed on a storage substrate and electrically insulated from each other, the collector electrodes having respective groups of strips arranged substantially alternately and in parallel spaced relation with one another at least in an effective region of the storage target which is to be bombarded by an electron beam, the two collector electrodes being adapted to be impressed with voltages and being effective to provide between themselves and the target substrate potential differences dependent upon differences in the voltages impressed upon each of said two collector electrodes;

(b) creating a potential difference between the collector electrodes of the storage target by applying different voltages thereto; and (c) bombarding the effective region of the storage target with an electron beam deflected in accordance with an input signal to be written thereon, in the presence of the potential difference between the collector electrodes.

19. A method of operation for a scan converter storage tube which comprises:

(a) providing a scan converter storage tube with a storage target having two collector electrodes formed on a storage surface of a storage substrate and electrically insulated from each other, the collector electrodes having respective groups of strips arranged substantially alternately and in parallel spaced relation with one another at least in an effective region of the storage target which is to be bombarded by an electron beam, the two collector electrodes being adapted to be impressed with voltages and being effective to provide between themselves and the target substrate potential differences dependent upon differences in the voltages impressed upon each of said two collector electrodes;

(b) applying to the collector electrodes different voltages such that the potential of the storage surface of the storage substrate is made higher than a first crossover potential at which the secondary emission ratio of the storage substrate first becomes unity;

(c) bombarding the effective region of the storage target with an electron beam deflected in accordance with an input signal to be written thereon, while the different voltages are being applied to the collector electrodes as in step (b), thereby writing the input signal on the storage target;

(d) applying to the collector electrodes the same voltage such that the potential of the storage surface of the storage substrate is made higher than the first crossover potential; and (e) scanning the entire effective region of the storage substrate with an unmodulated electron beam, while the same voltage is being applied to the collector electrodes as in step (d), thereby reading the stored signal from the storage target.

20. The operating method of claim 19 wherein the voltage applied to the collector electrodes of the storage target for reading the stored signal thereform is the highest of all voltage applied to various parts of the scan converter storage tube.

21. A method of operation for a scan converter storage tube which comprises:

(a) providing a scan converter storage tube with a storage target having first, second and third collector electrodes formed on a storage surface of a storage substrate and electrically insulated from one another, the collector electrodes having respective groups of strips extending in parallel spaced relation with one another and in the repetitive order of a first collector electrode strip, a third collector electrode strip, a second collector electrode strip and a third collector electrode strip at least in an effective region of the storage target which is to be bombarded by an electron beam, the three collector electrodes being adapted to be impressed with voltages and being effective to provide between themselves and the target substrate potential differences dependent upon differences in voltages being impressed upon each of said three collector electrodes;

(b) applying prescribed voltages to the collector electrodes to establish a potential difference between the first and third collector electrodes which is higher than a potential difference between the second a third collector electrodes;

(c) bombarding the effective region of the storage target with an electron beam deflected in accordance with a first input signal, while the prescribed voltages are being applied to the collector electrodes as in step (b), thereby writing the first input signal on the storage target;

(d) again applying prescribed voltages to the collector electrodes to establish a potential difference between the second and third collector electrodes which is higher than a potential difference between the first and third collector electrodes; and (e) again bombarding the effective region of the storage target with an electron beam deflected in accordance with a second input signal, while the prescribed voltages are being applied to the collector electrodes as in step (d), thereby writing the second input signal on the storage target.

22. A method of operation for a scan converter storage tube which comprises:

(a) providing a scan converter storage tube with a storage target having first, second and third collector electrodes formed on a storage surface of a storage substrate and electrically insulated from one another, the first, second and third collector electrodes having first, second and third groups of strips, respectively, extending in parallel spaced relation with one another in the repetitive order of a first collector electrode strip, a third collector electrode strip, a second collector electrode strip, and a third collector electrode strip at least in an effective region of the storage target which is to be bombarded by an electron beam, the collector electrodes leaving exposed, in the effective region, a first group of storage surface portions between the first and third groups of strips and a second group of storage surface portions between the second and third groups of storage surface portions, the three collector electrodes being adapted to be impressed with voltages and being effective to provide between themselves and the target substrate potential differences dependent upon differences in the voltages impressed upon each of said three collector electrodes;

(b) setting the potentials of the collector electrodes at such values that the first group of storage surface portions are open to electron beam bombardment whereas the second group of storage surface portions are shielded therefrom;

(c) bombarding the effective region of the storage target with an electron beam deflected in accordance with a first input signal, while the potentials of the collector electrodes are set as in step (b), thereby writing the first input signal on the first group of storage surface portions;

(d) resetting the potentials of the collector electrodes at such values that the second group of storage surface portions are open to electron beam bombardment whereas the first group of storage surface portions are shielded therefrom; and (e) again bombarding the effective region of the storage target with an electron beam deflected in accordance with a second input signal, while the potentials of the collector electrodes are set as in step (d), thereby writing the second input signal on the second group of storage surface portions.

23. A method of operation for a scan converter storage tube which comprises:

(a) providing a scan converter storage tube with a storage target having first, second and third collector electrodes formed on a storage surface of a storage substrate and electrically insulated from one another, the first, second and third collector electrodes having first, second and third groups of strips, respectively, extending in parallel spaced relation with one another and in the repetitive order of a first collector electrode strip, a third collector strip, a second collector electrode strip, and a third collector electrode strip at least in an effective region of the storage target which is to be bombarded by an electron beam, the collector electrodes leaving exposed, in the effective region, a first group of storage surface portions between the first and third groups of strips and a second group of storage surface portions between the second and third groups of storage surface portions, the three collector electrodes being adapted to be impressed with voltages and being effective to provide between themselves and the target substrate potential differences dependent upon differences in the voltages impressed upon each of said three collector electrodes;

(b) writing information in the first and second groups of storage surface portions;

(c) setting the potentials of the collector electrodes at such values that the information is readable from the first group of storage portions but not from the second group of storage surface portions;

(d) bombarding the complete effective region of the storage target with an unmodulated electron beam, while the potentials of the collector electrodes are set as in step (c), thereby reading part of the information from the first group of storage surface portions;

(e) resetting the potentials of the collector electrodes at such values that the information is readable from the second group of storage surface portions but not from the first group of storage surface poertions; and (f) again bombarding the complete effective region of the storage target with an unmodulated electron beam, while the potentials of the collector electrodes are set as in step (e), thereby reading the rest of the information from the second group of storage surface portions.

24. A method of operation for a scan converter storage tube which comprises:

(a) providing a scan converter storage tube with a storage target having first, second and third collector electrodes formed on a storage surface of a storage substrate and electrically insulated from one another, the first, second and third collector electrodes having first, second and third groups of strips, respectively, extending in parallel spaced relation with one another in the repetitive order of a first collector electrode strip, a third collector electrode strip, a second collector electrode strip, and a third collector electrode strip at least in an effective region of the storage target which is to be bombarded by an electron beam, the collector electrodes leaving exposed, in the effective region, a first group of storage surface portions between the first and third groups of strips and a second group of storage surface portions between the second and third groups of storage surface portions, the three collector electrodes being adapted to be impressed with voltages and being effective to provide between themselves and the target substrate potential differences dependent upon differences in the voltages impressed upon each of said three collector electrodes;

(b) writing information in the first and second groups of storage surface portions;

(c) setting the potentials of the collector electrodes at such values that the first group of storage surface portions are open to electron beam bombardment whereas the second group of storage surface portions are shielded therefrom, and that the potential of the first group of storage surface portions is made higher than a first crossover potential at which the secondary emission ratio of the storage substrate first becomes unity; and (e) bombarding the complete effective region of the storage target with an unmodulated electron beam, while the potentials of the collector electrodes are set as in step (c), thereby priming only the first group of storage surface portions.

25. A method of operations for a scan converter storage tube which comprises:

(a) providing a scan converter storage tube with a storage target having first, second and third collector electrodes formed on a storage surface of a storage substrate and electrically insulated from on another, the first, second and third collector electrodes having first, second and third groups of strips, respectively, extending in parallel spaced relation with one another and in the repetitive order of a first collector electrode strip, a third collector electrode strip, a second collector electrode strip, and a third collector electrode strip at least in an effective region of the storage target which is to be bombarded by an electron beam, the collector electrodes leaving exposed, in the effective region, a first group of storage surface portions between the first and third groups of strips and a second group of storage surface portions between the second and third groups of storage surface portions, the three collector electrodes being adapted to be impressed with voltages and being effective to provide between themselves and the target substrate potential differences dependant upon differences in voltages impressed upon each of said three collector electrodes;

(b) setting the potentials of the collector electrodes at different values such that the potentials of the first and second groups of storage surface portions become less than a first crossover potential at which the secondary emission ratio of the storage substrate first becomes unity;

(c) bombarding the complete effective region of the storage target with an unmodulated electron beam, while the potentials of the collector electrodes are set as in step (b), thereby providing different erase potential differences between the first group of storage surface portions and the first collector electrode and between the second group of storage surface portions and the second collector electrode; and (d) writing information on the first and second groups of storage surface portions.

26. A method of operation for a scan converter storage tube which comprises:

(a) providing a scan converter storage tube with a storage target having first, second and third collector electrodes formed on a storage surface of a storage substrate and electrically insulated from one another the first, second and third collector electrodes having first, second and third groups of strips, respectively, extending in parallel spaced relation with one another and in the repetitive order of a first collector electrode strip, a third collector electrode strip, a second collector electrode strip, and a third collector electrode strip at least in an effective region of the storage target which is to be bombarded by an electron beam, the collector electrodes leaving exposed, in the effective region, a first group of storage surface portion between the first and third group of strips and a second group of storage surface portions between the second and third groups of storage surface portions, the three collector electrodes being adapted to be impressed with voltages and being effective to provide between themselves and the target substrate potential differences dependant upon differences between the voltages impressed upon each of said three collector electrodes;

(b) setting the potentials of the collector electrodes at such values that the first group of storage surface portions acquire a first potential less than a first crossover potential at which the secondary emission ratio of the storage substrate first becomes unity and that the second group of storage surface portions are shielded against electron beam bombardment;

(c) bombarding the complete effective region of the storage target with an unmodulated electron beam, while the potentials of the collector electrodes are set as in step (b), thereby providing a first erase potential difference between the first collector electrode and the first group of storage surface portions;

(d) resetting the potentials of the collector electrodes at such values that the second group of storage surface portions acquire a second potential, different from the first potential, less than the first crossover potential and that the first group of storage surface portions are shielded against electron beam bombardment;

(e) again bombarding the complete effective region of the storage target with an unmodulated electron beam, while the potentials of the collector electrodes are set as in step (d), thereby providing a second erase potential difference, different from the first erase potential difference, between the second collector electrode and the second group of storage surface portions; and (f) writing information on the first and second groups of storage surface portions.

* * * * *